US008911061B2

(12) United States Patent
Sawada et al.

(10) Patent No.: US 8,911,061 B2
(45) Date of Patent: Dec. 16, 2014

(54) NOZZLE PLATE, NOZZLE PLATE PRODUCTION METHOD, LIQUID DISCHARGE HEAD, AND IMAGE FORMING APPARATUS

(71) Applicants: Kiyotaka Sawada, Kanagawa (JP); Jun Zhang, Kanagawa (JP)

(72) Inventors: Kiyotaka Sawada, Kanagawa (JP); Jun Zhang, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/019,662

(22) Filed: Sep. 6, 2013

(65) Prior Publication Data

US 2014/0078220 A1 Mar. 20, 2014

(30) Foreign Application Priority Data

Sep. 14, 2012 (JP) ..... 2012-202344

(51) Int. Cl.
*B41J 2/14* (2006.01)
*B41J 2/16* (2006.01)

(52) U.S. Cl.
CPC ..... *B41J 2/1433* (2013.01); *B41J 2/1626* (2013.01); *B41J 2/1645* (2013.01); *B41J 2/162* (2013.01); *B41J 2/1646* (2013.01); *B41J 2/161* (2013.01); *B41J 2/1642* (2013.01); *B41J 2/1632* (2013.01); *B41J 2/1629* (2013.01)
USPC ..... 347/47

(58) Field of Classification Search
None
See application file for complete search history.

(56) References Cited

U.S. PATENT DOCUMENTS

| | | | | |
|---|---|---|---|---|
| 7,367,656 | B2 * | 5/2008 | Cho et al. | 347/61 |
| 7,484,831 | B2 * | 2/2009 | Walmsley et al. | 347/49 |
| 7,636,993 | B2 * | 12/2009 | Okabe et al. | 29/25.35 |

FOREIGN PATENT DOCUMENTS

| | | |
|---|---|---|
| JP | 7-025015 | 1/1995 |
| JP | 9-024337 | 1/1997 |
| JP | 2003-341070 | 12/2003 |
| JP | 2004-351923 | 12/2004 |

* cited by examiner

*Primary Examiner* — Lamson Nguyen
(74) *Attorney, Agent, or Firm* — Cooper & Dunham LLP

(57) ABSTRACT

A nozzle plate includes a nozzle base; a nozzle hole to discharge droplets and formed on the nozzle base; and a water-repellent film formed on at least a liquid discharging surface of the nozzle base. The nozzle base is formed of a stainless material that includes a surface layer area on which the water-repellent film is formed. The surface layer area has a higher chrome density than the chrome density of the stainless material itself, and a ratio of Cr to Fe (Cr/Fe) in the surface layer area is equal to and more than 0.8. The nozzle plate production method as such includes polishing with a polishing agent a surface of the nozzle base; removing Fe in a surface layer area of the stainless material by etching using a polishing agent; and combining chrome with oxygen.

4 Claims, 15 Drawing Sheets

NOZZLE PLATE, NOZZLE PLATE PRODUCTION METHOD, LIQUID DISCHARGE HEAD, AND IMAGE FORMING APPARATUS

CROSS-REFERENCE TO RELATED APPLICATION

The present application claims priority pursuant to 35 U.S.C. §119 from Japanese patent application number 2012-202344, filed on Sep. 14, 2012, the entire disclosure of which is incorporated by reference herein.

BACKGROUND

1. Technical Field

The present invention relates to a nozzle plate, a nozzle plate production method, a liquid discharge head, and an image forming apparatus.

2. Related Art

An inkjet recording apparatus is known as an image forming apparatus employing a liquid discharging recording method, in which a recording head formed of a liquid discharge head (droplet discharge head) to discharge droplets is employed.

Because the droplets are discharged from nozzles in the liquid discharge head, the shape and quality of the nozzles greatly affect the volume and speed of liquid discharge. In addition, it is known that the surface properties of the base material in which the nozzle holes are formed also greatly affects discharge. For example, if ink is deposited around the nozzle hole in the surface of the nozzle base, the liquid is discharged in an unintended direction, or the size of the droplets varies, or the liquid discharge speed becomes unstable.

It is known that providing a water-repellent film (or an ink-repellent film) on the surface of the discharge side of the nozzle plate improves evenness of the discharge side of the nozzle and stabilizes liquid discharge.

In this case, because the discharge side of the nozzle plate is wiped clean during maintenance, it is necessary to prevent the water-repellent film from being peeled off from the nozzle base due to the wiping or that the water-repellent film should have wiping-resistant property.

As examples of a conventional nozzle plate, JP-2003-341070-A discloses a nozzle plate which is formed such that the surface of the nozzle base is provided with a $SiO_2$ film and a fluorinated water-repellent film is formed on the $SiO_2$ film. JP-H07-25015-A discloses a nozzle plate including a chrome layer, $SiO_2$ layer, and a siloxane-containing polyimide layer which are formed sequentially on the surface of the nozzle base and a fluorinated water-repellent film is formed on the siloxane-containing polyimide layer.

However, provision of the film or layer to improve adhesion between the water-repellent film to the surface of the nozzle base alone does not fully prevent the water-repellent film from being peeled off, and furthermore, the production cost rises due to the increased number of production processes.

SUMMARY

To solve the aforementioned problems, the present invention provides an improved nozzle plate that includes a nozzle base; a nozzle hole to discharge droplets and formed on the nozzle base; and a water-repellent film formed on at least a liquid discharging surface of the nozzle base. The nozzle base is formed of a stainless material that includes a surface layer area on which the water-repellent film is formed. The surface layer area has a higher chrome density than the chrome density of the stainless material itself, and a ratio of Cr to Fe (Cr/Fe) in the surface layer area is equal to and more than 0.8. The nozzle plate production method as such includes polishing with a polishing agent a surface of the nozzle base; removing Fe in a surface layer area of the stainless material by etching using a polishing agent; and combining chrome with oxygen. Then, the present invention provides improved adhesion between the nozzle base and the water-repellent film without increasing the number of production processes.

These and other objects, features, and advantages of the present invention will become apparent upon consideration of the following description of the preferred embodiments of the present invention when taken in conjunction with the accompanying drawings.

BRIEF DESCRIPTION OF THE DRAWINGS

FIGS. 8A and 8B are schematic views of a surface of the stainless steel illustrating a density of Cr in a surface layer thereof, of which FIG. 8A shows a state before polishing and FIG. 8B shows a state after polishing;

DETAILED DESCRIPTION

Figure 1:
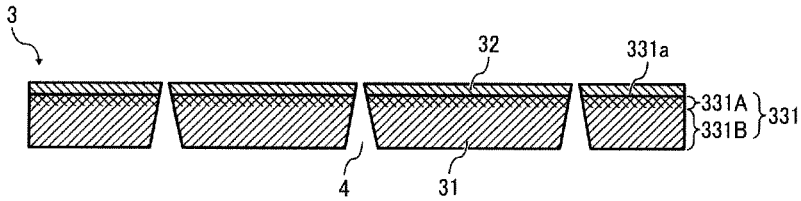
FIG. 1 is a cross-sectional view of a nozzle plate according to a first embodiment of the present invention.
Figure 2:
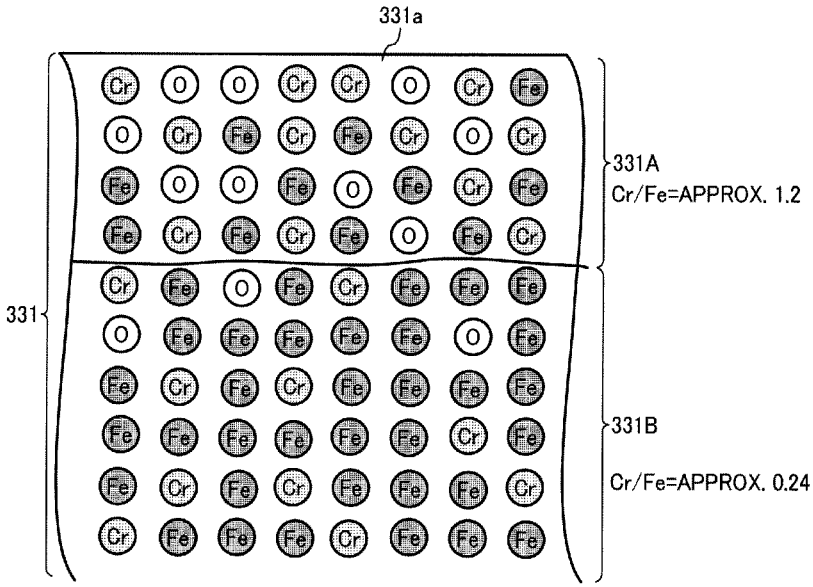
FIG. 2 is a schematic view of a nozzle base of the nozzle plate.

Hereinafter, preferred embodiments of the present invention will be described with reference to the accompanying drawings. A nozzle plate according to a first embodiment of the present invention will first be described with reference to FIGS. 1 and 2. FIG. 1 is a cross-sectional view of the nozzle plate; and FIG. 2 is a schematic view of a nozzle base of the nozzle plate.

The nozzle plate 3 includes a nozzle base 31 formed of a stainless material 331 and a water-repellent film 32 directly formed on a discharge side of the nozzle base 31.

Herein, the stainless material 331 to form the nozzle base 31 includes a surface layer area 331A on a side of the surface 331*a* on which the water-repellent film 32 is formed. In the surface layer area 331A, a chrome density (Cr/Fe) is higher than the chrome density (Cr/Fe) of the stainless material itself. As a result, the Cr density of the surface layer area 331A including the surface 331*a* on which the water-repellent film 32 is formed is higher than the Cr density of a base area 331B. More specifically, the Cr density (Cr/Fe) of the base area 331B of the stainless material is approximately 0.24 and that in the surface layer area 331A is approximately 1.2.

That the surface layer area 331A of the stainless material 331 as the nozzle base 31 on which the water-repellent film 32 is formed includes a higher Cr density means that easily-oxidizable chrome atoms combine with a greater number of oxygen atoms in the surface layer area 331A. When the water-repellent film 32 is formed, carbon atoms which are main components included in the water-repellent film 32 chemically bond with chrome atoms in the surface layer area 331A via hydrogen atoms in the surface layer area 331A, thereby obtaining a strong adhesion between the water-repellent film 32 and the nozzle base 31.

As a result, resistivity of the nozzle plate 3 against wiping action during maintenance improves.

As described above, the stainless material to form the nozzle base 31 includes the surface layer area 331A on the surface 331*a* on which the water-repellent film 32 is formed. In the surface layer area 331A, the chrome density (Cr/Fe) is higher than that of the stainless material itself, and is specifically more than 0.8. As a result, a production process which will be described later will be applied to the present nozzle base 31 and the adhesion between the nozzle base 31 and the water-repellent film 32 is improved without increasing the number of production processes.

Figure 3A:
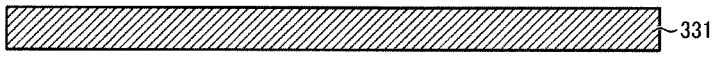
FIGS. 3A to 3D each are cross-sectional views of the nozzle plate illustrating a production method thereof according to the first embodiment of the present invention.

Next, a production method for a nozzle plate according to a first embodiment of the present invention will be described with reference to FIGS. 3A to 4. FIGS. 3A to 3D are cross-sectional views illustrating how to manufacture the nozzle plate; and FIG. 4 is an explanatory view illustrating how to polish the nozzle plate.

As illustrated in FIG. 3A, the stainless material 331 to be a nozzle base is prepared. Herein, as the stainless material 331, stainless SUS316L is used as a material, which is rolled out into a thin plate having a depth of 0.05 mm using a rolling machine.

Figure 3B:
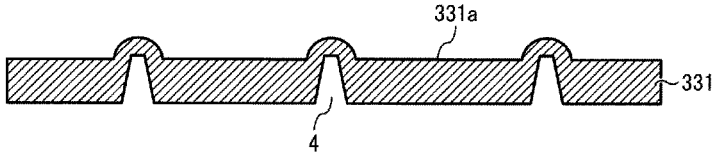
Figure 4:
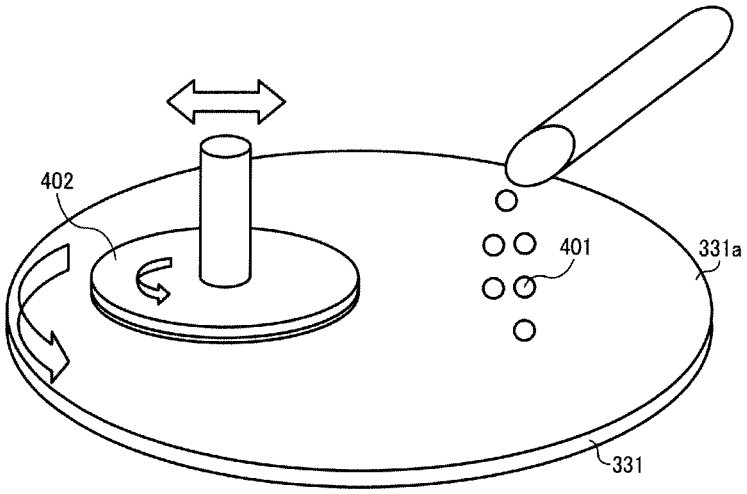
FIG. 4 is an explanatory view illustrating a polishing method.

Then, as illustrated in FIG. 3B, a plurality of half-cuts each for a nozzle 4 is formed at predetermined positions by press work on the stainless material 331. Herein, the press work is done using a punch with a cylinder-shaped apex having a diameter of 22 μm.

Figure 3C:
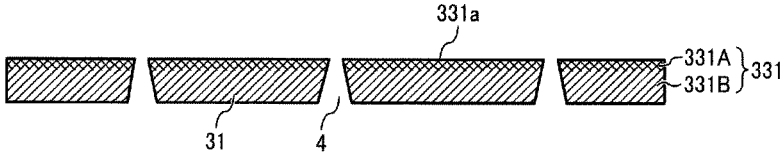

Then, as illustrated in FIG. 3C, the surface 331*a* on which the water-repellent film of the stainless material 331 is formed is polished using an ordinary mill, so that the nozzles 4 are formed on the stainless material 331.

Herein, in the polishing process, as illustrated in FIG. 4, a polishing agent 401 including oxidized aluminum particles with an average particle diameter of 1 μm and nitric acid is added in an appropriate quantity, a discotic polishing pad 420 (NH-C14B, a trade name, produced by Nitta Haas Incorporated) formed of foamed polyurethane is applied to the surface 331*a*, and while rotating the circular-disc polishing pad 420 and the stainless material 331, the surface 331*a* is polished to be planarized.

In the polishing process, the maximum cross-sectional depth of the roughness curve (measured by a method defined by JIS B06012001) is Rt=0.1 μm environ. $SiO_2$ particles may also be used other than the oxidized aluminum particles.

Through this polishing process, Fe included in the surface layer area 331A of the stainless material 331 is removed due to an etching effect of the polishing agent 401. Thus, as illustrated in FIG. 3C, the surface layer area 331A with a higher chrome density than that in the base area 331B of the stainless material 331 is formed.

Figure 3D:
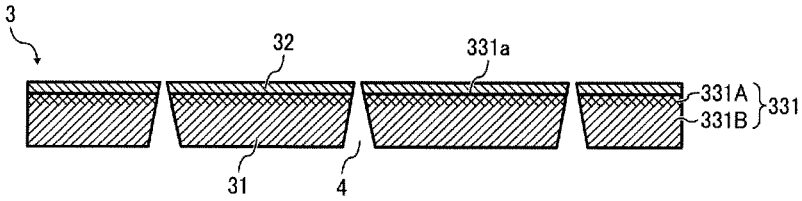

Then, as illustrated in FIG. 3D, the water-repellent film 32 is formed on the surface 331*a* of the stainless material 331.

Herein, a solution of polyamide acid is applied to the surface 331*a* of the stainless material 331 and dried, and the dried surface is then subjected to a thermal treatment to form the water-repellent film 32 formed of polyimide.

The water-repellent film 32 can be formed of liquid-repellent materials other than polyimide, including polyamide imide, fluorine containing polyimide, polytetrafluoroethylene (PTFE), perfluoropolyoxetane, modified perfluoropolyoxetane or the mixture thereof.

In addition, the formation of the water-repellent film 32 can be performed by various methods including spin coating, dipping, vacuum deposition, chemical vapor deposition (CVD), physical vapor deposition (PVD), sputtering, and ion plating.

Next, the higher Cr density in the surface layer area 331A of the stainless material 331 of the nozzle plate produced by the production method according to the first embodiment will be described.

First, a component analysis of the thus formed nozzle plate is performed using an X-ray photoelectron spectrometer (XPS), (K-Alpha, a trade name, produced by Thermo Fischer Scientific K.K.).

Figure 5A:
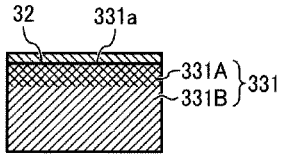
FIGS. 5A to 5C are explanatory views of the nozzle plate produced by the production method illustrating a component analysis using an X-ray photoelectron spectrometer (XPS) according to the first embodiment.
Figure 5B:
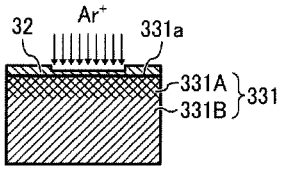
Figure 5C:
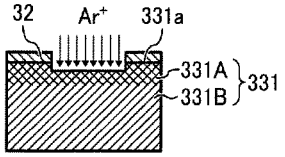

As illustrated in FIGS. 5A to 5C, the XPS method is method of analyzing components of a material, in which elements existing on the surface of the material sample are detected when argon ions dig into the surface of the sample surface. Herein, the analysis is done while digging from the polyimide layer being the water-repellent film 32 of the nozzle plate 3 toward the stainless SUS316L being the nozzle base 31.

Figure 6:
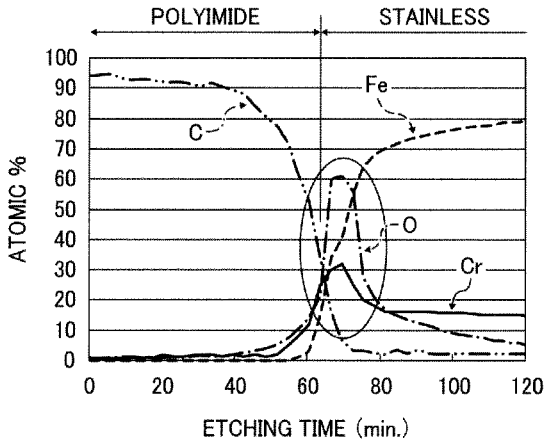
FIG. 6 is a graph illustrating a result of the component analysis.

FIG. 6 shows results of the analysis. In FIG. 6, a horizontal axis shows etching time or digging time. Because energy applied to the sample surface is constant, the etching time may indicate a depth from the sample surface. A vertical axis shows a ratio (atomic %) of the constituent elements depending on each etching time or depth.

Herein, among the constituent elements of polyimide, if the carbon having the highest component ratio is detected, an interface between the polyimide and the stainless SUS316L can be detected supersensitively. Accordingly, it can be thought that a position at which the etching time is approximately 60 min. is an interface between the polyimide or the water-repellent film 32 and the stainless SUS316L or the nozzle base 31.

Then, from the analysis result of FIG. 6, it can be seen that amounts of chrome and oxygen near the interface between the polyimide or the water-repellent film 32 and the stainless SUS316L or the nozzle base 31 have increased dramatically compared to the amounts of chrome and oxygen in the depth of the stainless base from the interface.

On the other hand, for comparison purposes, the nozzle hole is processed via etching using the stainless SUS316L for the nozzle base and ferric chloride for the etching solution. A nozzle plate with the water-repellent polyimide film is prepared (which is a nozzle plate as a comparative example 1). Then, similarly to the above case, a component analysis is done using the XPS. Unlike the nozzle plate producing method according to the first embodiment, in the comparative example 1, the polishing process as illustrated in FIG. 4 is not performed.

Figure 7:
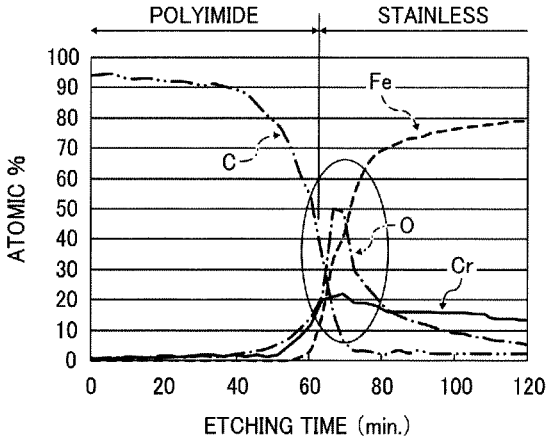
FIG. 7 is a graph illustrating a result of the component analysis by the XPS for a nozzle plate according to a first comparative example.

FIG. 7 shows results of the analysis. From the analysis result in FIG. 7, it is observed that the nozzle plate according to the comparative example 1 shows that amounts of chrome and oxygen near the interface between the polyimide or the water-repellent film and the stainless SUS316L or the nozzle base 31 apparently are less than the both amounts in the first embodiment.

Similarly, a nozzle plate according to a comparative example 2 is formed, in which stainless SUS316L is used as the nozzle base and ferric chloride is used as the etching solution. The nozzle hole is processed via etching, a thin chrome film is formed on the surface of the stainless SUS316L via the sputtering method, and a polyimide water-repellent film is formed on the thin chrome film (which is a nozzle plate as a comparative example 2). Then, a component analysis is done on the nozzle plate according to the comparative example 2 similarly to the above case. Specifically, also in the comparative example 2, the polishing process according to the first embodiment of the present invention as illustrated in FIG. 4 has not been performed, unlike the nozzle plate producing method according to the first embodiment.

Although the results of the analysis of the comparative example 2 are not illustrated, the nozzle plate of this comparative example 2 shows a very low amount of oxygen near the interface between the polyimide and thin chrome film.

Figure 8A:
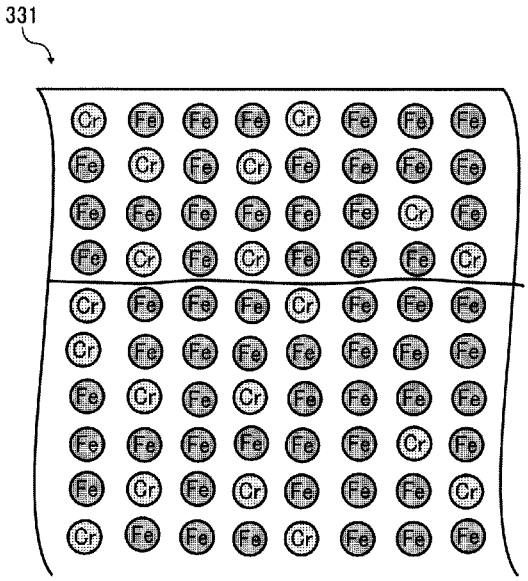
Figure 8B:
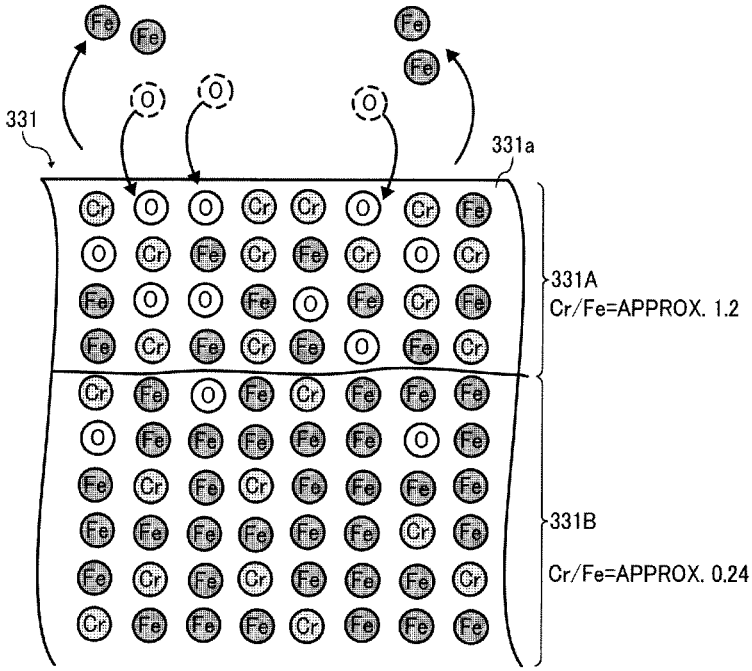

From the above results, it can be seen that, through the polishing process performed on the stainless material 331 as the nozzle base 31 as illustrated in FIG. 8A, the Fe included in the surface layer area 331A of the stainless material 331 has been removed due to the etching by the polishing agent 401 as illustrated in FIG. 8B, so that the chrome density (Cr/Fe) increases, and because chrome tends to combine with oxygen, it is conceivable that a chrome-abundant film is formed on the stainless material 331.

Thus, the production method according to the present invention improves adhesion between the nozzle base and the water-repellent film without increasing the number of production processes.

Next, a liquid discharge head including a nozzle plate according to the first embodiment and nozzle plates according to the comparative examples 1 and 2 are prepared and mounted to the image forming apparatus, and properties thereof evaluated.

The nozzle plate prepared according to the method of the first embodiment show excellent printing quality. Specifically, even after extended use, the discharge trajectory of the droplet was not deflected due to the peeling-off of the water-repellent film 32, and no inconvenience occurred such as an unstable liquid ejection speed. In addition, it was confirmed that after 15,000 wipings, the contact angle was not degraded.

By contrast, the nozzle plate according to both comparative examples 1 and 2 exhibited deterioration of contact angle after 5,000 times of wiping.

As a result, in the nozzle plate according to the first embodiment, the amounts of chrome and oxygen in the vicinity of the interface between the polyimide and the stainless SUS316L greatly affect the adhesion between the nozzle base and the water-repellent film. Because chrome included in the surface layer and carbon, the main constituent element, chemically bond via an intermediary of oxygen included in the surface layer area, adhesion is improved compared to the comparative examples 1 and 2.

Figure 9:
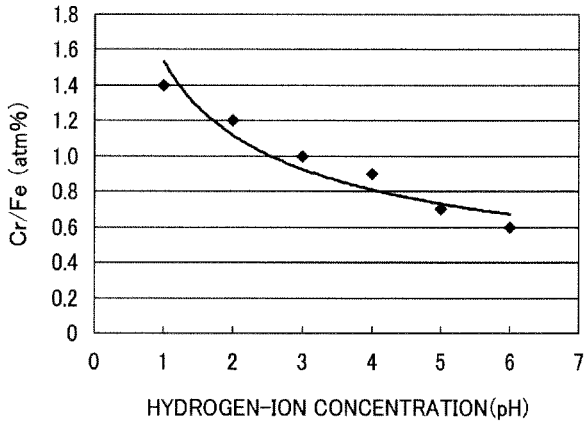
FIG. 9 is a graph illustrating a relation between the chrome density (Cr/Fe) in the surface layer of the stainless material and the density (pH) of the hydrogen ion of the polishing agent in the polishing process.

Referring to FIG. 9, a relation between the chrome density (Cr/Fe) in the surface layer of the stainless plate and the density (pH) of the hydrogen ion of the polishing agent in the polishing process will be described. FIG. 9 is a graph illustrating a relation between the chrome density (Cr/Fe) in the surface layer of the stainless plate and the density (pH) of the hydrogen ion of the polishing agent in the polishing process.

From FIG. 9, it is apparent that, as the density (pH) of the hydrogen ion of the polishing agent decreases, that is, as the acidity increases, the chrome density increases.

Herein, in general, the surface layer of the stainless tends to be provided with an immobile film having a thickness of from 1 to 4 nm formed of chrome oxide. The chrome oxide layer is a thin, chrome-abundant layer in which chrome included in the stainless material and the oxygen in the air are bonded. Then, the chrome density (Cr/Fe) as a material composition in the surface of the chrome oxide layer is approximately 0.4 in normal air.

By contrast, in the present embodiment, the stainless surface is polished using the polishing agent including nitric acid. By performing the polishing, generation of the chrome oxide is accelerated in the surface layer of the stainless material 331 than in the air due to the oxidation of the nitric acid included in the polishing agent. As a result, by performing the polishing process, the chrome density (Cr/Fe) becomes equal to or more than 0.6 atomic percent.

Results of an evaluation of the performance of the nozzle plate having a chrome density (Cr/Fe) equal to or more than 0.6 atomic % show that, as Cr/Fe ratio increases, the adhesion between the nozzle base and the water-repellent film increases. Results of wiping tests show that anti-wiping property also is improved. It is conceived that the wiping property is improved due to the improved adhesion between the nozzle base and the water-repellent film if the hydrogen ion density (pH) of the polishing agent is lowered or the acidity is higher and the chrome density (Cr/Fe ratio) is larger.

However, if the acidity of the polishing agent becomes too high, the nozzle base tends to be soluble, so that a desired dimensional precision cannot be obtained. In addition, the chrome tends to be soluble, and the chrome density in the surface layer area of the nozzle base may be undesirably decreased. In addition, if the acidity of the polishing agent is high, polishing equipment itself tends to be degraded and corroded due to oxidation of the polishing agent, resulting in a shortened lifetime of the equipment. Further, the polishing agent with a lower hydrogen ion density (pH) or higher acidity is difficult to handle.

Accordingly, the chrome density (Cr/Fe) in the surface layer of the stainless material being the nozzle base is preferably $Cr/Fe \geq 0.8$, and more preferably $0.8 \geq Cr/Fe \leq 1.2$, so that while securing good adhesion between the nozzle base and the water-repellent film and good dimensional precision, deterioration of the polishing equipment is prevented and the ease of handling of the polishing agent can be maintained.

In addition, if the particularly preferable chrome density of $0.8 \leq Cr/Fe \leq 1.2$ is to be obtained, it is understood that, from FIG. 9, the hydrogen ion density (pH) of the polishing agent is preferably $2 \leq pH \leq 4$.

Figure 10:
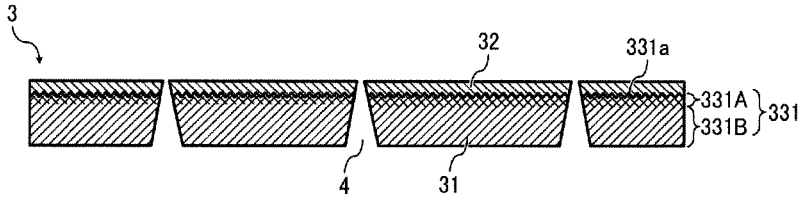
FIG. 10 is a cross-sectional view of a nozzle plate according to a second embodiment of the present invention.

Next, a nozzle plate according to a second embodiment of the present invention will be described with reference to FIG. 10. FIG. 10 is a cross-sectional view illustrating how to produce the nozzle plate.

In the present embodiment, a surface of the nozzle base 31, that is, a surface of the surface layer area 331A of the stainless material 331, is roughened.

Due to the anchoring effect of the roughened surface, adhesion between the nozzle base 31 and the water-repellent film 32 further increases, so that anti-wiping property dramatically increases.

Next, a production method for the nozzle plate according to the second embodiment of the present invention will be described with reference to FIGS. 11A to 11D.

Figure 11A:
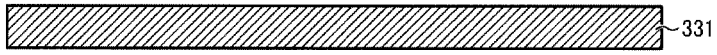
FIGS. 11A to 11D each are cross-sectional views of a nozzle plate illustrating a production method thereof according to the second embodiment of the present invention.

As illustrated in FIG. 11A, the stainless material 331 to be a nozzle base is prepared. Herein, stainless SUS316L is used as a material as the stainless material 331, which is rolled into a thin plate having a thickness of 0.05 mm using a rolling machine.

Figure 11B:
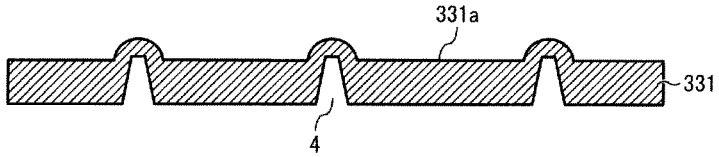

Then, as illustrated in FIG. 11B, a plurality of half-cuts each for the nozzle 4 is formed at predetermined positions by press work on the stainless material 331. Herein, the press work was done using a punch with a cylinder-shaped apex having a diameter of 22 μm.

Figure 11C:
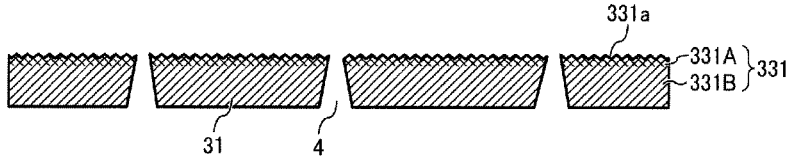

Then, as illustrated in FIG. 11C, the surface 331*a* on which the water-repellent film of the stainless material 331 is formed is polished using an ordinary mill, so that the nozzles 4 are formed on the stainless material 331.

Herein, in the polishing process, the polishing agent containing oxidized aluminum particles having an average particle diameter of 5 μm and nitric acid is dropped on the surface 331*a* of the stainless material 331 in several droplets, and the discoidal polishing pad 420 (NH-C14B, a trade name, produced by Nitta Haas Incorporated) formed of foamed polyurethane is applied to the surface 331*a*, and while rotating the discoidal polishing pad 420 and the stainless material 331, the surface 331*a* is polished to be planarized.

In the polishing process, the maximum cross-sectional depth of the roughness curve (measured by a method defined by JIS B06012001) is Rt=0.3 μm environ. In the present embodiment, a type of polishing agent to cause the surface roughness to be rougher than that in the polishing process according to the first embodiment is provided. As particles to be included in the polishing agent 401, $SiO_2$ particles may also be used other than the oxidized aluminum particles.

Through this polishing process, as illustrated in FIG. 11C, the surface layer area 331A with a higher chrome density than that in the base area 331B of the stainless material 331 is formed.

Figure 11D:
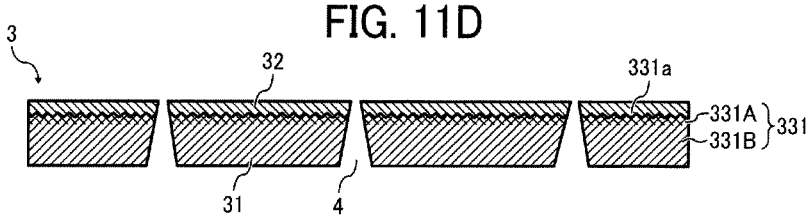

Then, as illustrated in FIG. 11D, the water-repellent film 32 is formed on the surface 331*a* of the stainless material 331.

Herein, a solution of polyamide acid is applied to the surface 331*a* of the stainless material 331 and dried, and the dried surface is subjected to a thermal treatment, so that the water-repellent film 32 formed of polyimide is formed.

Next, a liquid discharge head including the nozzle plate according to the second embodiment is prepared and mounted to the image forming apparatus, and properties thereof evaluated.

The nozzle plate prepared according to the method of the second embodiment exhibited excellent printing quality. Specifically, even after extended use, the discharge trajectory of the droplet is not deflected due to the peeling-off of the water-repellent film 32, and no inconvenience occurred such as an unstable liquid ejection speed. In addition, it was confirmed that after 18,000 wipings, the contact angle was not degraded.

As described above, the nozzle plate according to the second embodiment exhibited further improved adhesion between the nozzle base 31 and the water-repellent film 32 and the anti-wiping property is dramatically improved. This is because: (1) the chrome density of the surface layer area 331A of the stainless material 331 as the nozzle base 31 on which the water-repellent film 32 is formed is high, when the water-repellent film 32 is formed, and carbon being a main constituent element included in the water-repellent film 32 chemically bonds with chrome in the surface layer area 331A by an intermediary of oxygen in the surface layer area 331A; and (2) the surface status of the surface layer area 331A is roughened intentionally to exert an anchoring effect.

Figure 12:
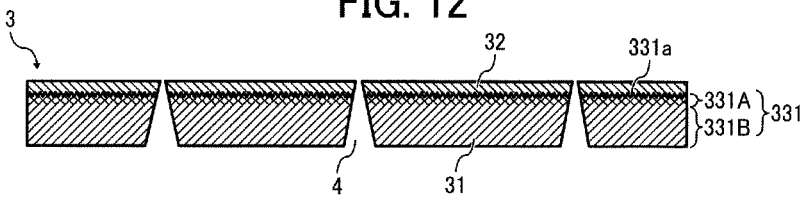
FIG. 12 is a cross-sectional view of a nozzle plate according to a third embodiment of the present invention.

Next, a nozzle plate according to a third embodiment of the present invention will be described with reference to FIG. 12, which is a cross-sectional view of the nozzle plate.

In the present embodiment, a surface of the nozzle base 31, that is, a surface of the surface layer area 331A of the stainless material 331, is activated.

Due to the activated surface, adhesion between the nozzle base 31 and the water-repellent film 32 further increases, so that anti-wiping property dramatically increases.

Next, a production method for the nozzle plate according to the third embodiment of the present invention will be described with reference to FIGS. 13A to 13D, which are cross-sectional views illustrating how to produce the nozzle plate.

Figure 13A:
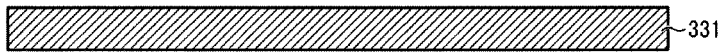
FIGS. 13A to 13D are cross-sectional views of a nozzle plate illustrating a production method thereof according to the second embodiment of the present invention.

As illustrated in FIG. 13A, the stainless material 331 to be a nozzle base is prepared. Herein, stainless SUS316L used as the stainless material 331 is rolled into a thin plate having a thickness of 0.05 mm using a rolling machine.

Figure 13B:
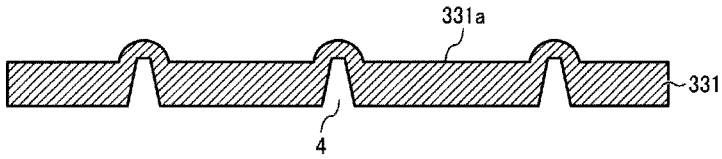

Then, as illustrated in FIG. 13B, a plurality of half-cuts each for a nozzle 4 is formed at predetermined positions by press work on the stainless material 331. Herein, the press work was done using a punch with a cylinder-shaped apex having a diameter of 22 μm.

Figure 13C:
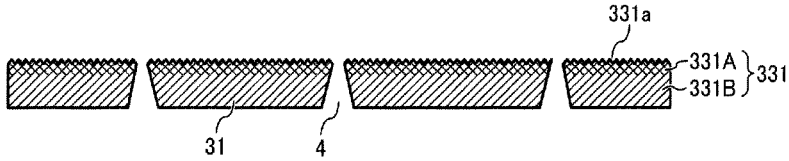

Then, as illustrated in FIG. 13C, the surface 331*a* on which the water-repellent film of the stainless material 331 is formed is polished using an ordinary mill, so that the nozzles 4 are formed on the stainless material 331.

Herein, in the polishing process, the polishing agent containing oxidized aluminum particles with an average particle diameter of 1 μm and nitric acid is dropped on the surface 331*a* of the stainless material 331 in several droplets, and the discoidal polishing pad 420 (NH-C14B, a trade name, produced by Nitta Haas Incorporated) formed of foamed polyurethane is applied to the surface 331*a*, and while rotating the discoidal polishing pad 420 and the stainless material 331, the surface 331*a* is polished to be planarized.

In the polishing process, the maximum cross-sectional depth of the roughness curve (measured by a method defined by JIS B06012001) was Rt=0.1 μm environ. $SiO_2$ particles may also be used other than the oxidized aluminum particles.

Through this polishing process, as illustrated in FIG. 13C, the surface layer area 331A having a higher chrome density than that in the base area 331B of the stainless material 331 is formed.

Figure 13D:
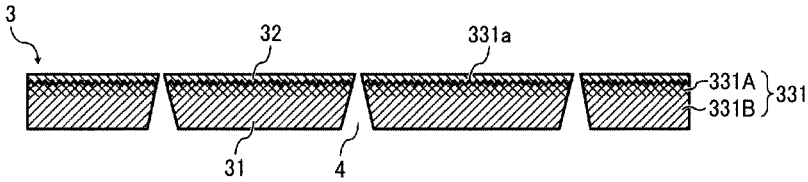

Then, as illustrated in FIG. 13D, the surface 331*a* of the surface layer area 331A of the stainless material 331 is activated by plasma treatment so that the chrome and oxygen can be reacted with other elements easily, and the water-repellent film 32 is thus formed. In the present embodiment the plasma treatment uses argon.

In addition, a varnish-like polyamide-imide is applied to the surface 331*a* of the stainless material 331 to a predetermined depth by a spin coating method, the coated surface 331*a* is heated by a microwave oven for 30 to 60 minutes to between 100 and 140 degrees C. to remove any solvent and the surface is dried, so that the water-repellent film 32 is formed.

Then, the liquid discharge head provided with the nozzle plate thus created according to the third embodiment is prepared, is mounted to the image forming apparatus, and properties thereof evaluated.

The nozzle plate according to the third embodiment exhibited excellent printing quality. Specifically, even after extended use, the discharge trajectory of the droplet is not deflected due to the peeling-off of the water-repellent film 32, and no inconvenience occurred such as an unstable liquid ejection speed. In addition, it was confirmed that after 18,000 wipings, the contact angle was not degraded.

As described above, the nozzle plate according to the third embodiment includes further improved adhesion between the nozzle base 31 and the water-repellent film 32 and the anti-wiping property is dramatically improved. This is because: (1) the chrome density of the surface layer area 331A of the stainless material 331 as the nozzle base 31 on which the water-repellent film 32 is formed is high, when the water-repellent film 32 is formed, and carbon being a main constituent element included in the water-repellent film 32 chemically bonds with chrome in the surface layer area 331A by an intermediary of oxygen in the surface layer area 331A; and (2) the surface of the surface layer area 331A has been activated, and then the water-repellent film 32 is formed.

Figure 14:
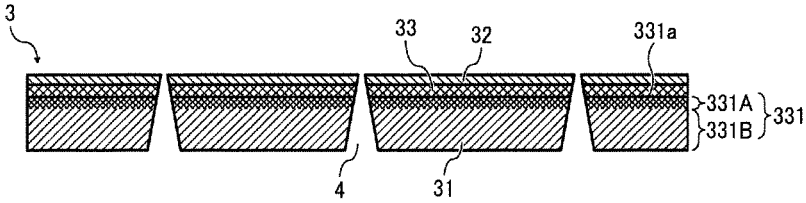
FIG. 14 is a cross-sectional view of a nozzle plate according to a fourth embodiment of the present invention.

Next, a nozzle plate according to a fourth embodiment of the present invention will be described with reference to FIG. 14. FIG. 14 is a cross-sectional view of the nozzle plate.

In the present embodiment, the $SiO_2$ film 33 is formed as a ground layer on the surface of the nozzle base 31 (that is, the surface of the surface layer area 331A of the stainless material 331), and the water-repellent film 32 is formed on the $SiO_2$ film 33.

Due to the disposition of the $SiO_2$ film 33, adhesion between the nozzle base 31 and the $SiO_2$ film 33 further increases. The adhesion between the $SiO_2$ film 33 and the water-repellent film 32 is high originally, and the anti-wiping property dramatically increases.

Next, a production method for the nozzle plate according to the fourth embodiment of the present invention will be described with reference to FIGS. 15A to 15E. FIGS. 15A to 15E are cross-sectional views illustrating how to produce the nozzle plate.

Figure 15A:
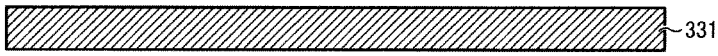
FIGS. 15A to 15E each are cross-sectional views of a nozzle plate illustrating a production method thereof according to the fourth embodiment of the present invention.

As illustrated in FIG. 15A, the stainless material 331 to be a nozzle base is prepared. Herein, stainless SUS316L used as the stainless material 331 is rolled into a thin plate having a thickness of 0.05 mm using a rolling machine.

Figure 15B:
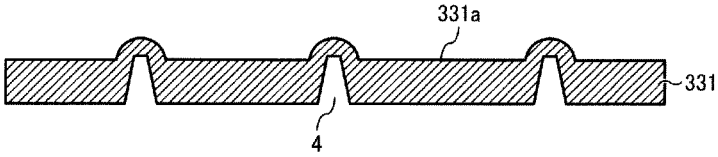

Then, as illustrated in FIG. 15B, a plurality of half-cuts each for the nozzle 4 is formed at predetermined positions by press work on the stainless material 331. Herein, the press work was done using a punch with a cylinder-shaped apex having a diameter of 22 μm.

Figure 15C:
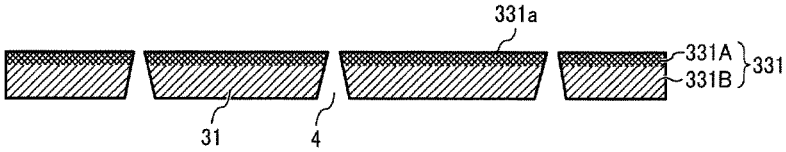

Then, as illustrated in FIG. 15C, the surface 331*a* on which the water-repellent film of the stainless material 331 is formed is polished using an ordinary mill, so that the nozzles 4 are formed on the stainless material 331.

Herein, in the polishing process, the polishing agent containing oxidized aluminum particles with an average particle diameter of 1 μm and nitric acid is dropped on the surface 331*a* of the stainless material 331 in several droplets, and the discoidal polishing pad 420 (NH-C14B, a trade name, produced by Nitta Haas Incorporated) formed of foamed polyurethane is contacted to the surface 331*a*, and while rotating the discoidal polishing pad 420 and the stainless material 331, the surface 331*a* is polished to be planarized.

In the polishing process, the maximum cross-sectional depth of the roughness curve (measured by a method defined by JIS B06012001) is Rt=0.1 μm environ. $SiO_2$ particles may also be used other than the oxidized aluminum particles.

Through this polishing process, as illustrated in FIG. 15C, the surface layer area 331A with a higher chrome density than that in the base area 331B of the stainless material 331 is formed.

Figure 15D:
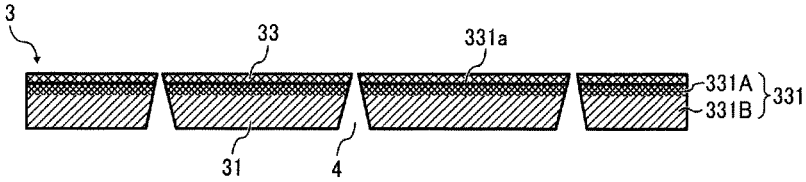

Then, as illustrated in FIG. 15D, the $SiO_2$ film 33 is formed on the surface 331*a* of the surface layer area 331A of the stainless material 331.

Herein, an Si film is formed on the surface 331*a* of the surface layer area 331A, and then, an $SiO_2$ film 33 is formed by applying $O_2$ ion on the surface of the Si film. A preferable film thickness of the $SiO_2$ film 33 is from several Å to 1,000 Å environ, and in the present fourth embodiment, the film thickness is set to 80 nm (800 Å).

Figure 15E:
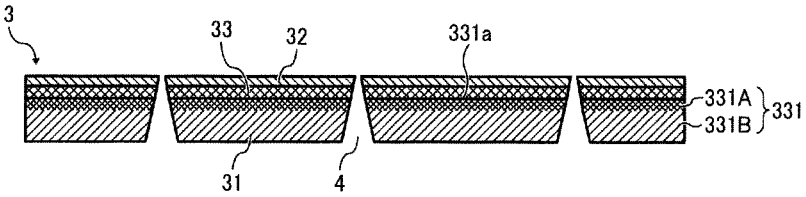

Then, as illustrated in FIG. 15E, the water-repellent film 32 is formed on the surface layer area 331A of the stainless material 331.

Herein, in the present fourth embodiment, perfluoroether with modified chain ends of alkoxysilane OPTOOL DSX (a product name manufactured by DAIKIN Industries, Ltd.) is used and the water-repellent film 32 is formed by vacuum deposition.

Next, a liquid discharge head including the nozzle plate produced according to the fourth embodiment of the present invention is prepared and mounted to the image forming apparatus, and properties thereof have been evaluated. As a result, the nozzle plate thus prepared exhibited excellent printing quality. Specifically, even after extended use, the discharge trajectory of the droplet is not deflected due to the peeling-off of the water-repellent film 32, and no inconvenience occurred such as an unstable liquid ejection speed. In addition, it was confirmed that after 18,000 wipings, the contact angle was not degraded.

As described above, the nozzle plate according to the fourth embodiment includes further improved adhesion between the surface layer area 331A and the $SiO_2$ film 33 and the anti-wiping property is dramatically improved. This is because the chrome density of the surface layer area 331A of the stainless material 331 as the nozzle base 31 on which the water-repellent film 32 formed is high, so the $SiO_2$ film 33 chemically bonds with chrome in the surface layer area 331A via an intermediary of oxygen in the surface layer area 331A.

Figure 16:
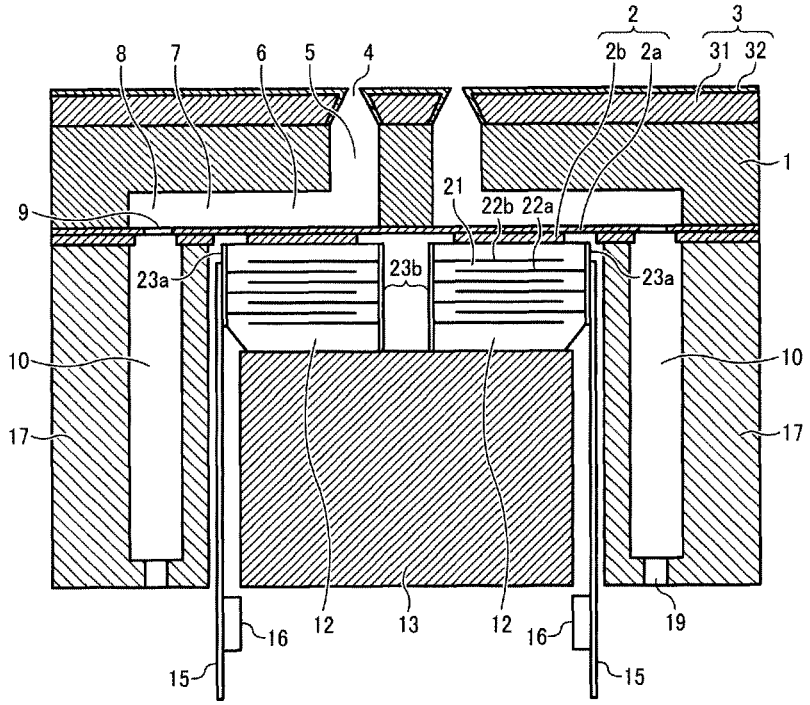
FIG. 16 is a cross-sectional view illustrating an example of a droplet discharge head in a direction perpendicular to a nozzle arrangement direction or a liquid chamber longitudinal direction.
Figure 17:
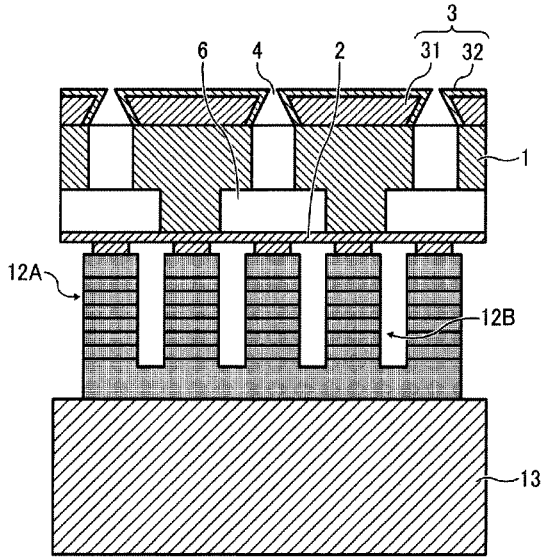
FIG. 17 is a cross-sectional view illustrating the droplet discharge head along the liquid chamber shorter-side direction.

Next, an example of the liquid discharge head according to the present invention will be described with reference to FIGS. 16 and 17. FIG. 16 is a cross-sectional view of the droplet discharge head along a direction perpendicular to the nozzle alignment direction of the same head, (that is, along a liquid chamber longitudinal direction). FIG. 17 is a cross-sectional view of the head along the nozzle alignment direction (along a shorter-side of the liquid chamber).

This droplet discharge head includes a flow passage plate (a liquid chamber substrate or a flow passage member) 1; a diaphragm 2 bonded to a bottom surface of the flow passage plate 1; and a nozzle plate 3 bonded to an upper surface of the flow passage plate 1.

Further included are a plurality of liquid chambers 6, a fluid resistance portion 7 serving also as an ink supply path, and a through-hole 8 communicating with the liquid chamber 6 via the fluid resistance portion 7. A plurality of nozzles 4 each discharges droplets and communicates to these chambers through each path 5. The diaphragm 2 is provided with a supply port 9 through which ink is supplied from a common liquid chamber 10 formed with a frame member 17 to the through-hole 8.

Each opening of the path 5, the liquid chamber 6, and the fluid resistance portion 7 of the flow passage plate 1 is formed by etching a silicon substrate. For example, the flow passage plate 1 can be formed such that the SUS substrate is subjected to etching using acidic etching aqueous fluid or mechanical processing such as punching.

The diaphragm 2 includes a vibration area (or the diaphragm portion) 2*a* forming each wall section corresponding to each liquid chamber 6. A convex island 2*b* is formed outside the vibration area 2*a* (opposite wall of the liquid chamber 6). A layered-type piezoelectric member 12 includes pillar piezoelectric elements 12A, 12B, (hereinafter, referred to as a piezoelectric pillar), to generate energy to discharge droplets. An upper edge surface of the piezoelectric elements 12A, 12B is connected to the convex island 2*b*. In addition, a bottom surface of the layered-type piezoelectric member 12 is connected to a base member 13.

Herein, the piezoelectric member 12 includes a piezoelectric material layer 21 such as PZT and internal electrodes 22*a*, 22*b*, which are alternately laminated one on top of the other. The internal electrodes 22*a* and 22*b* are connected with edge electrodes (external electrodes) 23*a* and 23*b* formed on a side wall. When a voltage is applied to the edge electrodes 23*a* and 23*b*, the piezoelectric member 12 displaces in the layered direction thereof. The piezoelectric member 12 is processed by a half-cut-off singulation so as to have grooves and a predetermined number of piezoelectric pillars 12A, 12B are formed with respect to one piezoelectric member 12.

The piezoelectric pillars 12A, 12B of the piezoelectric member 12 are materially the same, but differ in function insofar as the piezoelectric pillar which is driven by being supplied with a drive waveform is the piezoelectric pillar 12A, and the piezoelectric pillar which is not supplied with a drive waveform and serves simply as a pillar is the piezoelectric pillar 12B. In this case, as described in FIG. 16, either a bipitch structure in which the piezoelectric pillar 12A for driving and the piezoelectric pillar 12B simply as a pillar are alternately disposed or a normal pitch structure in which all piezoelectric pillars are used as the driver piezoelectric pillar 12A can be used.

Accordingly, two rows of piezoelectric pillars 12A each of which includes a plurality of driver piezoelectric pillars 12A are arranged in rows on the base member 13.

In addition, in the present embodiment, a structure to pressurize ink inside the liquid chamber 6 is adopted using an orientation of d33 direction as a piezoelectric direction of the piezoelectric member 12. Alternatively, however, a structure to pressurize ink inside the liquid chamber 6 toward d31 direction using as a piezoelectric direction of the layered-type piezoelectric member 12 can also be adopted.

An FPC 15 is wiring means for providing drive signals and is directly connected to an external electrode 23*a* of the driver piezoelectric pillar 12*a* of the piezoelectric member 12. A driving circuit (or a driver IC) 16 selectively applying drive waveforms to each driver piezoelectric pillar 12A is mounted to the FPC 15. All external electrodes 23*a* of the piezoelectric pillar 12A are electrically connected commonly and are connected to a common wiring of the FPC 15 as well.

The nozzle plate 3 as described in the embodiments is used, and the water-repellent film 32 is formed on the liquid discharging side surface of the nozzle base 31 in which nozzle holes to form the nozzles 4 each having a diameter of from 10 to 35 μm are formed corresponding to each liquid chamber 6, and on an interior surface of the nozzle 4.

A frame member 17 is formed using epoxy resins or polyphenylene sulfide which is injection-molded and disposed at an external periphery of the piezoelectric actuator unit which is formed of the piezoelectric member 12 on which the FPC 15 is mounted and the base member 13. The frame member 17 includes the common liquid chamber 10 and a supply port 19 to supply ink from outside to the common liquid chamber 10. The supply port 19 is further connected to an ink supply source such as a sub tank or an ink cartridge.

In the thus-configured droplet discharge head, if, for example, the voltage to be applied to the driver piezoelectric pillar 12A is lowered from the reference potential, the piezoelectric pillar 12A is contracted, the vibration area 2*a* of the diaphragm 2 is lowered, and a volume of the liquid chamber 6 is expanded. Thus, the ink flows into the liquid chamber 6. When the voltage to be applied to the piezoelectric pillar 12A is increased, the piezoelectric pillar 12A expands in the layered direction and the diaphragm 2 is deformed toward the nozzle 4 so that the liquid inside the liquid chamber 6 is pressurized, and then, the droplet is jet from the nozzle 4.

When the voltage applied to the piezoelectric pillar 12A is resumed to the reference potential, the diaphragm 2 returns to an initial position, the liquid chamber 6 expands to generate a negative pressure. At this time, the liquid chamber 6 is filled with the recording liquid from the common liquid chamber 10. Then, after vibration of the meniscus surface of the nozzle 4 is damped and stabilized, the operation proceeds to a next droplet discharging.

The head driving method is not limited to the above example (pull-and-push jet), and alternatively a pull-jet or a push-jet method can be adopted depending on the direction given by the driving waveform.

The foregoing description is of a case in which the piezoelectric-type actuator is used as the liquid discharge head; however, alternatively, the liquid discharge head may similarly use a thermal-type actuator including electrothermal transformation elements, electrostatic actuator including a vibration plate and an opposed electrode, and the like.

Figure 18:
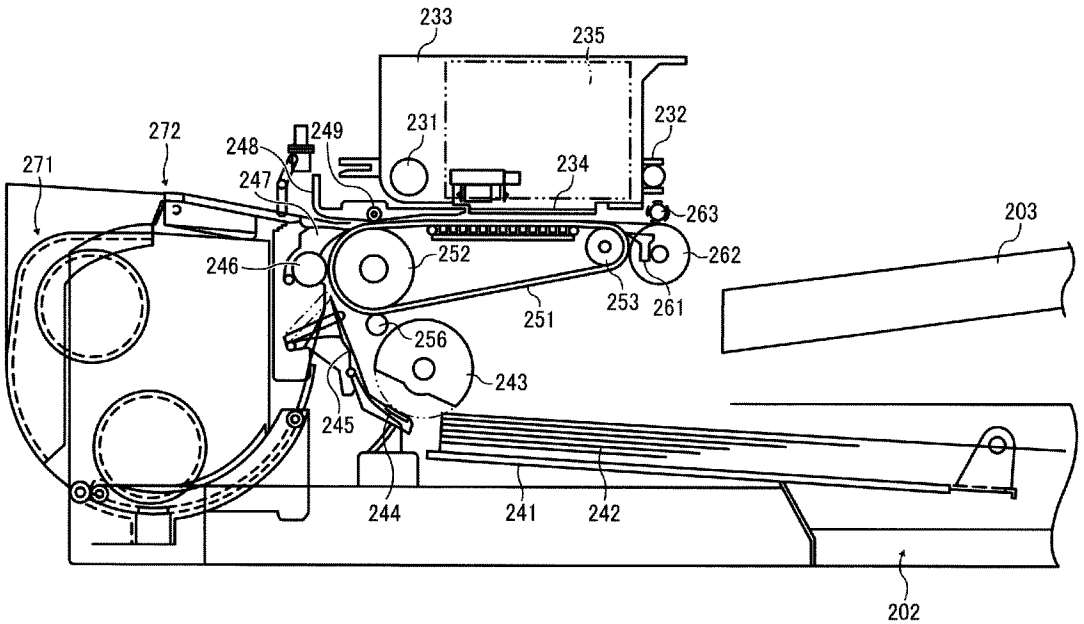
FIG. 18 is a cross-sectional side view of an image forming apparatus illustrating an overall configuration thereof according to the present invention.
Figure 19:
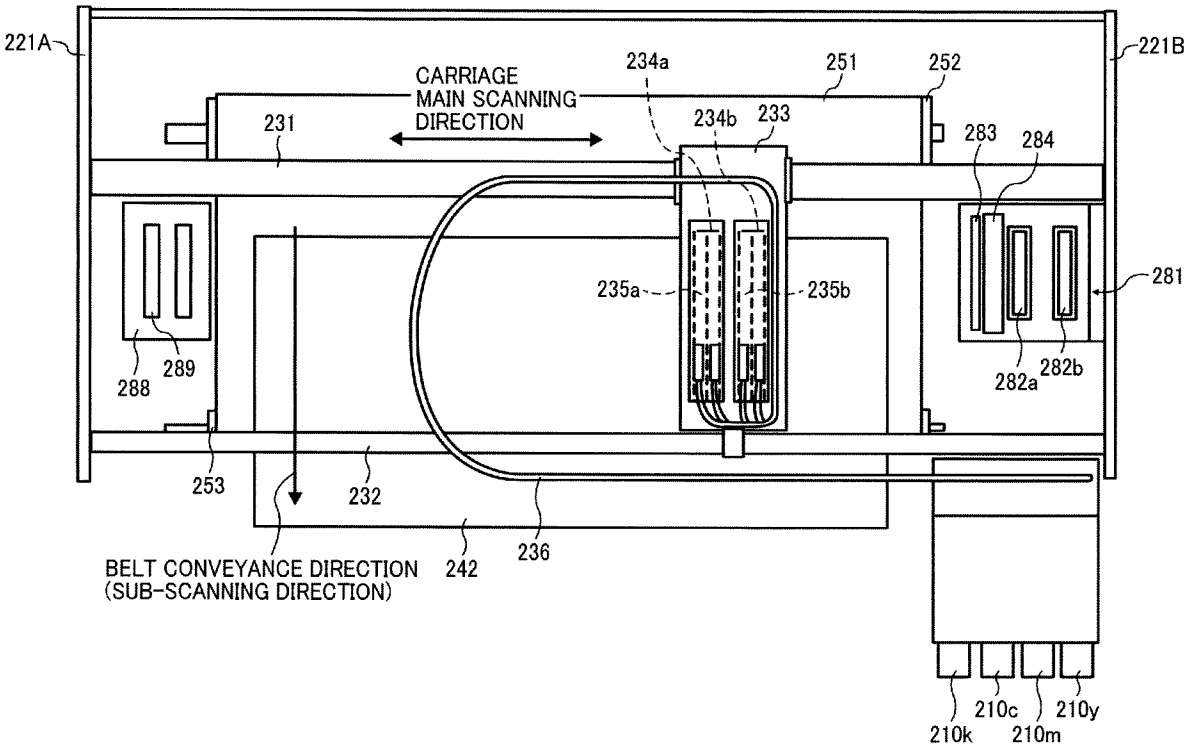
FIG. 19 is a plan view illustrating a main part of the image forming apparatus.

Next, an example of the liquid discharge head according to the present invention will be described with reference to FIGS. 18 and 19. FIG. 18 is a side view of the image forming apparatus illustrating a mechanical structure thereof, and FIG. 19 is a plan view illustrating the main part of the image forming apparatus of FIG. 18.

This image forming apparatus is a serial-type image forming apparatus recording apparatus, including a main and auxiliary guide rods 231, 232 laterally held by side plates 221A, 221B, and a carriage 233 which is slideably held by the guide rods 231, 232 to be movable in a main scanning direction and scans while moving in an arrow direction driven by a main scanning motor via a timing belt.

A recording head 234 is mounted on the carriage 233. The recording head 234 is integrally formed of: liquid discharge heads to discharge ink droplets of respective colors of yellow (Y), cyan (C), magenta (M), and black (K) according to the present embodiment; and a tank to contain the appropriate ink to be supplied to the heads. The thus integrally formed recording head 234 includes nozzle arrays formed of a plurality of nozzles arranged in a sub-scanning direction perpendicular to the main scanning direction, with the ink droplet discharge trajectory oriented downward.

Specifically, the recording head 234 includes two nozzle arrays. One of the nozzle arrays of the recording head 234*a* discharges droplets of black (K) and the other nozzle array discharges droplets of cyan (C). One of the nozzle arrays of the recording head 234*b* discharges droplets of magenta (M) and the other discharges droplets of yellow (Y), respectively. Herein, four colors of droplets are discharged using two heads, but it can be configured such that one head includes four nozzle arrays and four colors of droplets can be discharged from one head.

In addition, each color ink is supplied from each ink cartridge 210 to a tank 235 of the recording head 234 via a supply tube 236 for each color.

There is provided a sheet feeding section from which sheets of paper 242 stacked on a sheet stacker (or a pressure plate) 241 of a sheet tray 202 are conveyed. The sheet feeding section includes a sheet feed roller 243 to separate and feed each sheet 242 from the sheet stacker 241 one by one and a separation pad 244 facing the sheet feed roller 243 and formed of a material having a high friction coefficient. The separation pad 244 is pressed against the sheet feed roller 243.

Then, to convey the sheet 242 supplied from the sheet feed section to the lower side of the recording head 234, a guide member 245 to guide the sheet 242, a counter roller 246, a conveyance guide member 247, a pressure member 248 including an end press roller 249, and a conveyance belt 251, which is a conveying means to electrostatically attract the fed sheet 242 and convey it at a position facing the recording head 234, are disposed.

This conveyance belt 251 is an endless belt stretching around a conveyance roller 252 and a tension roller 253, and is so configured as to rotate in a belt conveyance direction (i.e., a sub-scanning direction). In addition, a charging roller 256, which is a charging means to charge a surface of the conveyance belt 251, is provided. The charging roller 256 is disposed in contact with the surface layer of the conveyance belt 251 and is rotated by the rotation of the conveyance belt 251. The conveyance belt 251 is rotated in a belt conveyance direction by the rotation of the conveyance roller 252 driven by a sub-scanning motor, not shown.

Further, as a sheet ejection portion to eject the sheet 242 on which an image has been recorded by the recording head 234, a separation claw 261 to separate a sheet 242 from the conveyance belt 251, and sheet discharge rollers 262, 263, are disposed. A sheet discharge tray 203 is provided underneath the sheet discharge roller 262.

A duplex unit 271 is detachably provided at a backside of the apparatus body. This duplex unit 271 pulls in a sheet 242 which has been returned by a reverse rotation of the conveyance belt 251, reverses the sheet 242, and feeds the reversed sheet 242 again between the counter roller 246 and the conveyance belt 251. Further, an upper surface of the duplex unit 271 is used as a manual sheet feed tray 272.

Furthermore, a maintenance mechanism 281 including a recovery means to maintain the nozzles of the recording head 234 in good condition is provided at a non-printing area at one side in the scanning direction of the carriage 233. The maintenance mechanism 281 includes: cap members 282*a*, 282*b* (referred to collectively as a cap 282); a wiper blade 283 as a blade member to wipe the surface of the nozzle; and a first dummy discharge receiver 284 to receive droplets dummy-discharged so as to remove agglomerated recording liquid which is not contributive to a normal recording operation.

Further, a second dummy discharge receiver 288 is disposed at a non-printing area at the other side in the scanning direction of the carriage 233. The second dummy discharge receiver 288 receives droplets of dummy-discharged recording liquid performed to remove agglomerated recording liquid of a higher viscosity during printing. The second dummy discharge receiver 288 includes openings 289 positioned along the nozzle array direction of the recording head 234.

In the thus-configured image forming apparatus, the sheets 242 are separated and fed one by one from the sheet feed tray 202. The sheet 242 is then fed upward in a substantially vertical direction is guided by the guide member 245, and is conveyed while being sandwiched between the conveyance belt 251 and the counter roller 246. The leading edge of the sheet 242 is then guided by the conveyance guide member 237, the sheet 242 is pressed against the conveyance belt 251 by the end press roller 249, and its direction is changed by 90 degrees.

At this time, an alternating voltage, which is an alternating repetition of positive and negative voltages, is applied to the charge roller 256. Thus, the conveyance belt 251 is charged in an alternating charge pattern, in which positive charges alternate with negative charges of a predetermined duration in a strip shape in the sub-scanning direction, which is the direction of rotation of the conveyance belt 251. When the sheet 242 is fed on the thus-alternately-charged conveyance belt 251, the sheet 242 is attracted by the conveyance belt 251 and is conveyed in the sub-scanning direction by the rotation of the conveyance belt 251.

Then, the recording head 234 is driven in response to image signals while moving the carriage 233 to allow it to discharge ink droplets onto the stopped sheet 242 to record a single line. After the sheet 242 is conveyed by a predetermined amount, a next line is recorded. Upon receiving a recording end signal or a signal indicating that a trailing edge of the sheet 242 has reached the recording area, the recording operation is terminated and the sheet 242 is ejected to the sheet discharge tray 203.

As a result, because the image forming apparatus includes the liquid discharge head according to preferred embodiments of the present invention as a recording head, a high quality image is reliably formed.

In this patent specification, "sheet" is not limited to the paper material, but also includes an OHP sheet, fabrics, boards, etc., on which ink droplets or other liquid are deposited. The term "sheet" is a collective term for a recorded medium, recording medium, recording sheet, and the like. The term "image formation" means not only recording, but also printing, image printing, and the like.

The term "image forming apparatus" means a device for forming an image by impacting ink droplets to media such as paper, thread, fiber, fabric, leather, metals, plastics, glass, wood, ceramics, and the like. "Image formation" means not only forming images with letters or figures having meaning to the medium, but also forming images without meaning such as patterns to the medium (and impacting the droplets to the medium).

The "ink" is not limited to so-called ink, but means and is used as an inclusive term for every liquid such as recording liquid, fixing liquid, and aqueous fluid to be used for image formation, which further includes, for example, DNA samples, registration and pattern materials and resins.

The term "image" is not limited to a plane two-dimensional one, but also includes a three-dimensional one, and the image formed by three-dimensionally from the 3D figure itself.

Further, the image forming apparatus includes, otherwise limited in particular, any of a serial-type image forming apparatus and a line-type image forming apparatus.

Additional modifications and variations of the present invention are possible in light of the above teachings. It is therefore to be understood that, within the scope of the appended claims, the invention may be practiced other than as specifically described herein.

What is claimed is:

1. A nozzle plate comprising:

a nozzle base;

a nozzle hole to discharge droplets and formed on the nozzle base; and a water-repellent film formed on at least a liquid discharging surface of the nozzle base, wherein the nozzle base is formed of a stainless material, the stainless material includes a surface layer area on which the water-repellent film is formed and has a higher chrome density than the chrome density of the stainless material itself, and wherein a ratio of Cr to Fe (Cr/Fe) in the surface layer area is equal to and more than 0.8.

2. The nozzle plate as claimed in claim 1, wherein a material of the water-repellent film is polyimide, polyamide imide, fluorine containing polyimide, polytetrafluoroethylene (PTFE), perfluoropolyoxetane, modified perfluoropolyoxetane or the mixture thereof.

3. A droplet discharging head comprising the nozzle plate as claimed in claim 1.

4. An image forming apparatus comprising the droplet discharging head as claimed in claim 3.

* * * * *